United States Patent [19]

Cherry et al.

[11] Patent Number: 4,508,409

[45] Date of Patent: Apr. 2, 1985

[54] INSULATION PIERCING COAXIAL GRIP SPLICE DEVICE

[75] Inventors: Hitesh Cherry, Harrisburg; Walter M. Werner, Downington, both of Pa.

[73] Assignee: AMP Incorporated, Harrisburg, Pa.

[21] Appl. No.: 508,648

[22] Filed: Jun. 28, 1983

[51] Int. Cl.[3] ..... H01R 11/20; H01R 4/50

[52] U.S. Cl. ..... 339/97 R; 174/84 R; 339/248 S; 339/273 F; 403/311

[58] Field of Search ..... 174/84 R, 84 S, 90; 24/136 R; 403/310, 311, 313, 314, 369; 339/95 R, 96, 97 R, 97 C, 248 R, 248 S, 268 R, 268 S, 273 R, 273 F, 273 S, 274

[56] References Cited

U.S. PATENT DOCUMENTS

| | | | |
|---|---|---|---|
| 1,488,636 | 4/1924 | Geiser | 339/95 R X |
| 2,259,261 | 10/1941 | Miller et al. | 174/84 R |
| 2,316,267 | 4/1943 | McLarn | 174/84 R |
| 3,681,512 | 8/1972 | Werner et al. | 174/84 R |
| 3,952,377 | 4/1976 | Morell | 24/136 R |
| 4,408,926 | 10/1983 | Werner | 403/311 X |

FOREIGN PATENT DOCUMENTS

| | | | |
|---|---|---|---|
| 483458 | 5/1952 | Canada | 174/84 S |

*Primary Examiner*—Joseph H. McGlynn
*Assistant Examiner*—Steven C. Bishop
*Attorney, Agent, or Firm*—Allan B. Osborne

[57] ABSTRACT

The present invention relates to a device for splicing two insulated electrical wires or cables. More particularly, the device includes two or more elongated members cooperating to form a cylindrical, cable receiving body with tapered outer surfaces adapted to slidingly receive collars which compress the elongated members against the cables. Insulation piercing prongs are driven into the cable to contact the underlying conductors to establish electrical continuity between the two cables.

5 Claims, 7 Drawing Figures

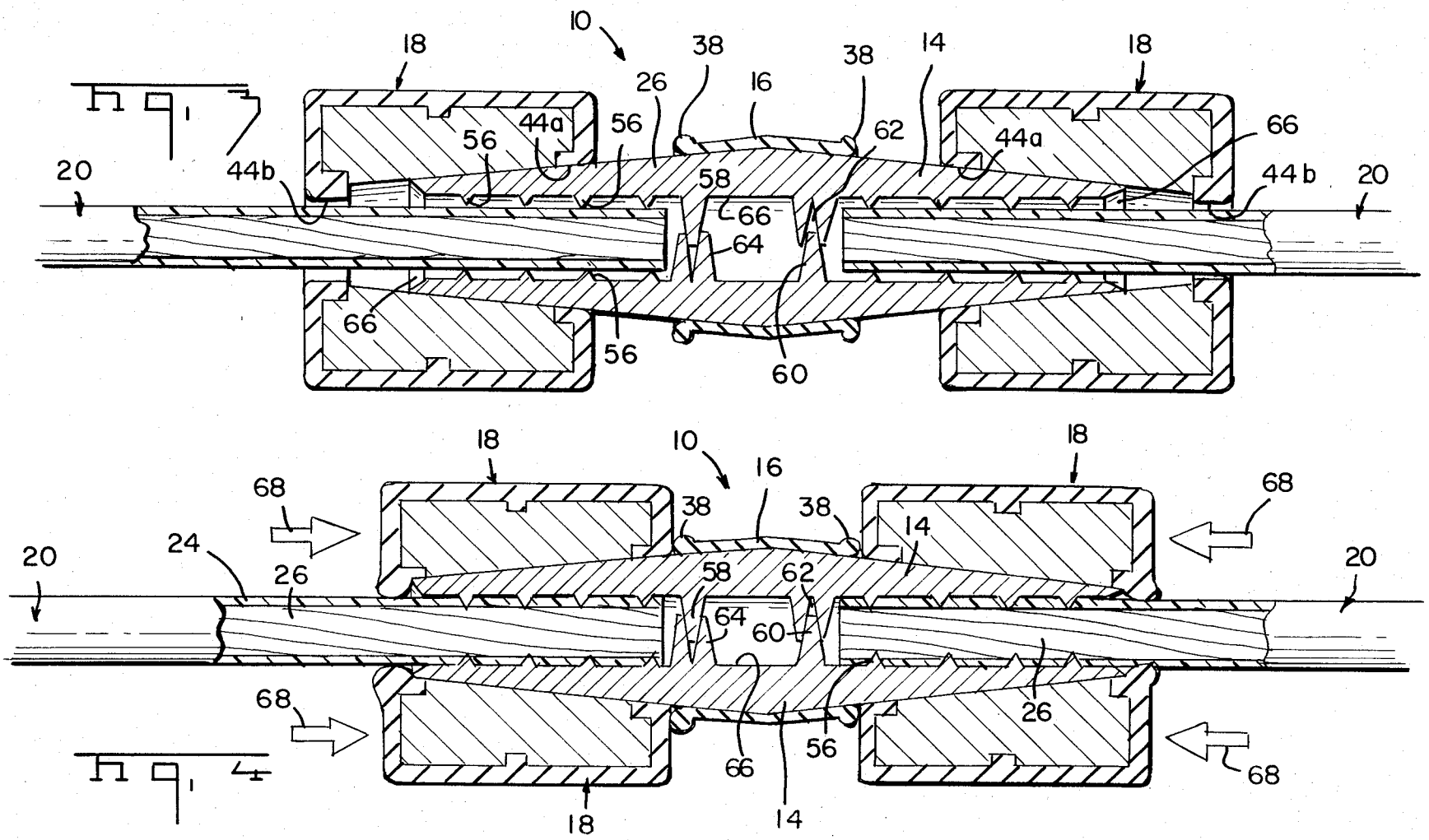
10
14
16
18
20
24
26
38
44a
44b
56
58
60
62
64
66
68

INSULATION PIERCING COAXIAL GRIP SPLICE DEVICE

BACKGROUND OF THE INVENTION

1. Field of the Invention

The invention disclosed herein relates to devices for electrically joining two, end-to-end electrical cables without removing the insulating jacket therefrom.

2. Prior Art

U.S. Pat. No. 4,080,034 illustrates one embodiment of an insulation piercing device. Parallel, spaced-apart cables are electrically joined by a contact positioned between the cables and having insulation piercing teeth on both ends. Piercing and commoning occurs upon bolting together the two sections of a housing containing the contact and into which the cables have been positioned.

U.S. Pat. No. 4,103,984 illustrates an embodiment of a device for electrically joining two insulated cables placed end-to-end. An elongated, conductive body member is provided with an axial passage and with several threaded bores normal to and intersecting the passage in a predetermined pattern. With cables inserted into the passage from each end, bolts are threaded into the bores, engaging and cutting through the insulating jacket and making contact with the underlying conductors.

SUMMARY OF THE PRESENT INVENTION

The invention disclosed herein includes a number of elongated shells having, in transverse cross section, an inner concave surface and an outer convex surface. Further, the outer surfaces are beveled uniformly from the midpoint out to each end. The shells form, when assembled, an elongated body with an outer surface converging towards each end and a circular passage extending therethrough. The inner surfaces carry spacing means so that the assembled shells are automatically spaced apart a predetermined distance to define the proper diameter of the circular passage. The concave surfaces, in one embodiment, have a number of teeth projecting inwardly. Further included are a pair of collars having a predetermined inner diameter such that, when positioned on and driven onto the body towards the midpoint, squeeze the shells further together to drive the teeth through the insulation and into the underlying conductors of cables positioned in the passage.

A second embodiment includes pins slidably mounted transversely in the shells so that as the collars are driven thereonto, they press the pins into the shell assembly passage and into the cables positioned therein.

BRIEF DESCRIPTION OF THE DRAWINGS

FIGS. 3 and 4 are cross-sectional, longitudinal or side elevation views of the embodiment of FIG. 1 showing internal details thereof and also illustrating the mode of operation;

DESCRIPTION OF THE INVENTION

Figures 1, 2:
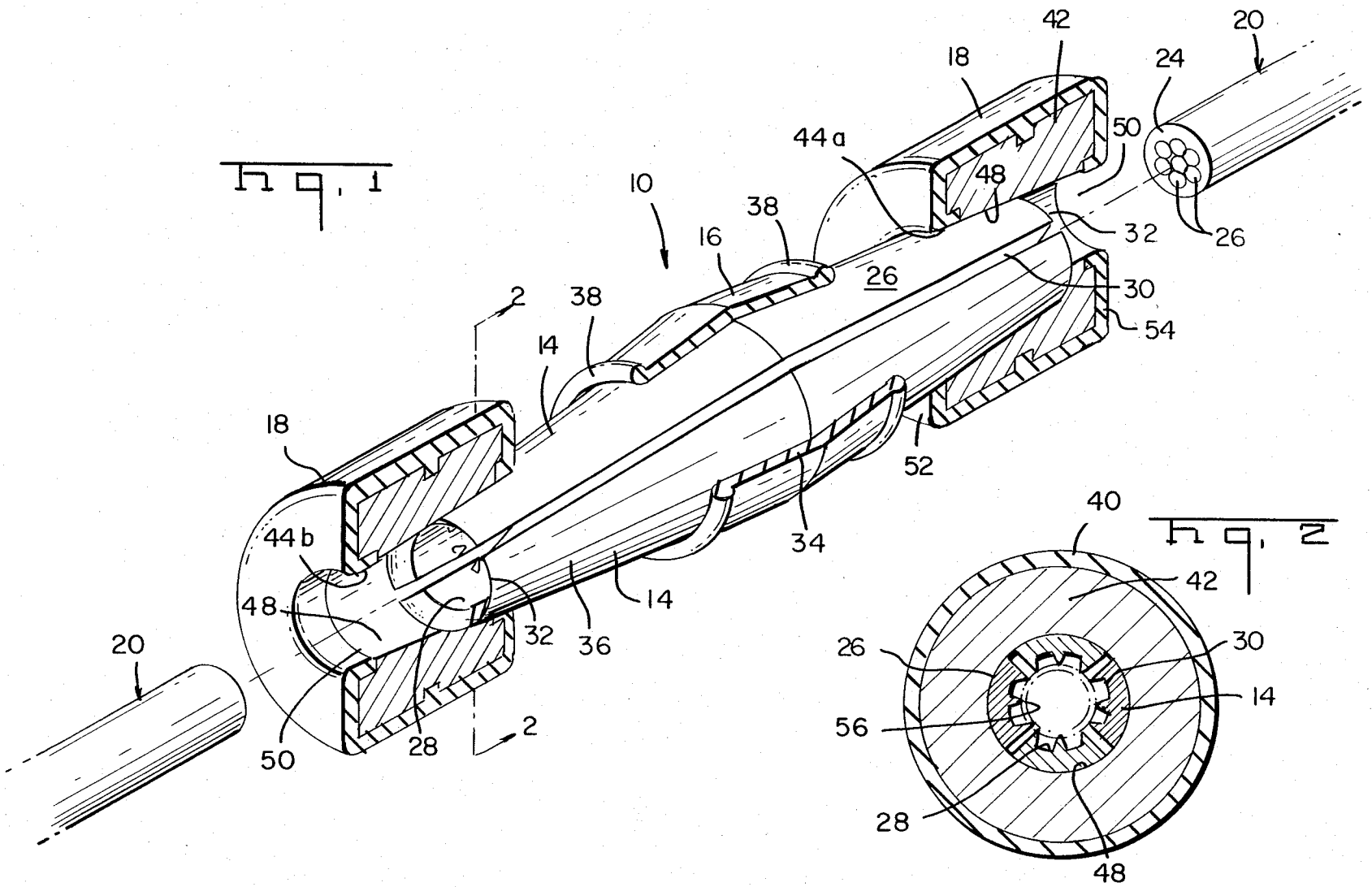
FIG. 1 is an isometric view, with some components sectioned, of one embodiment of the present invention.
FIG. 2 is a cross-sectional end view taken along line 2—2 of FIG. 1.
Figure 5:
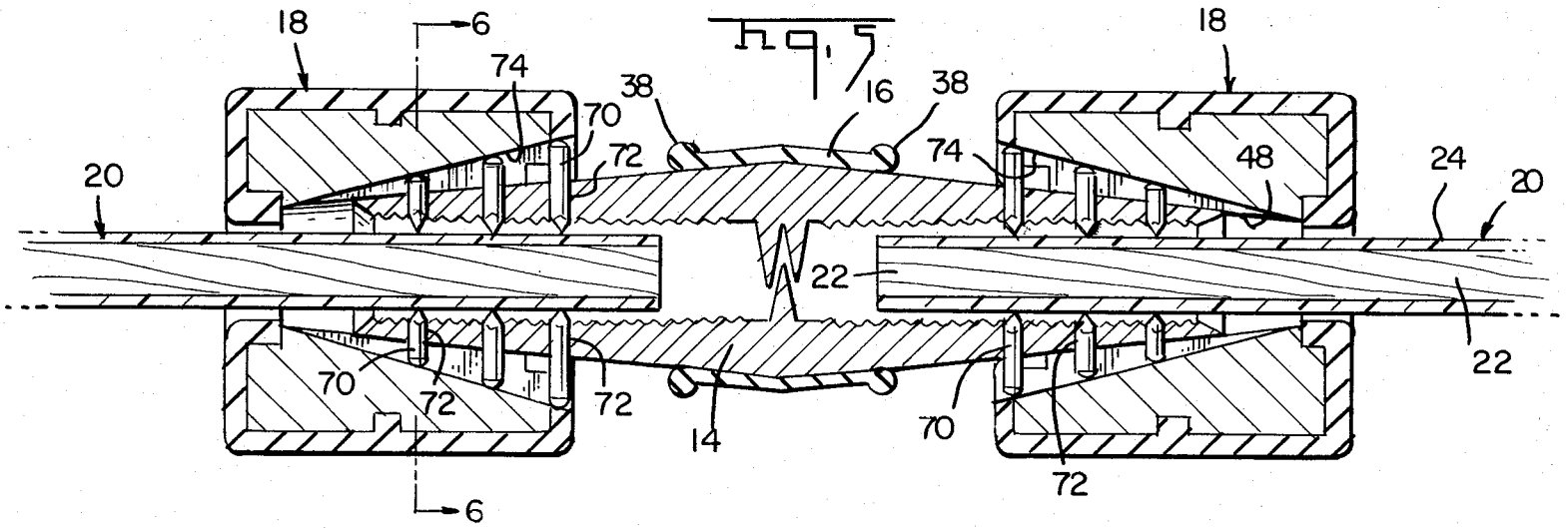
FIG. 5 is a cross-sectional, side elevation view of a second embodiment of the present invention.
Figure 7:
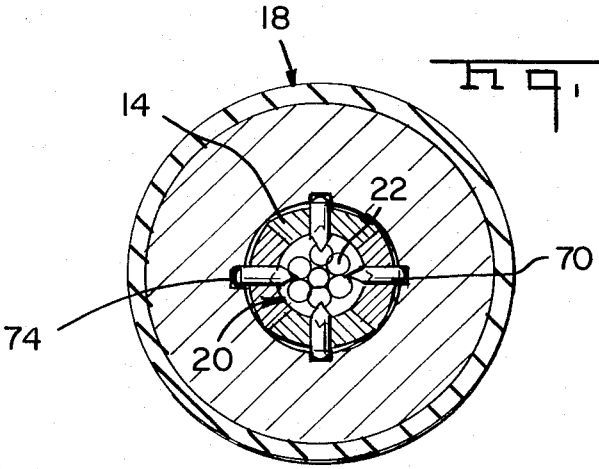
FIG. 7 is a cross-sectional end view similar to FIG. 6 but subsequent to the cable being terminated via the embodiment of FIG. 5.
Figure 6:
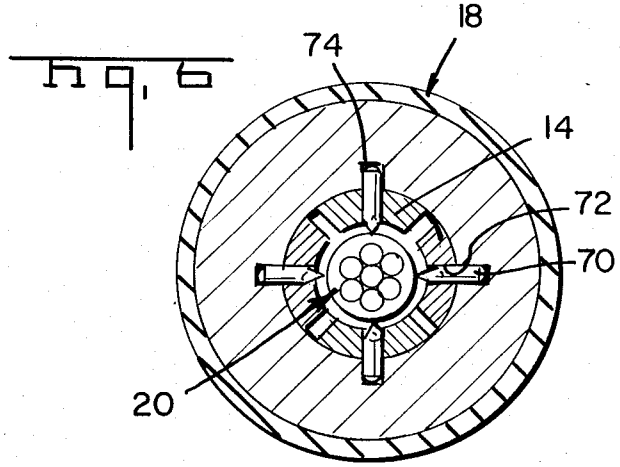
FIG. 6 is a cross-sectional end view taken along line 6—6 of FIG. 5.

Two embodiments of the present invention are illustrated in the drawings and described herein, one being shown in FIGS. 1–4, indicated by reference numeral 10, and the other in FIGS. 5–7, indicated by reference numeral 12. FIG. 1, however, shows the components generic to both embodiments. These components include two or more shells 14, a retaining ring 16 and two collars 18. FIG. 1 also shows two insulated electrical cables 20 which are of the type suitable for splicing together by means of device 10 or 12, i.e., the cable consists of several strands of conductors 22 surrounded by a protective insulating jacket 24.

Shells 14 are elongated with a convex outer surface 26 and a concave inner surface 28 with the direction of curvature being transverse to the longitudinal axis. Edges 30 are provided between the two surfaces. The shell thickens from ends 32 inwardly to midpoint 34 with the thickening being reflected entirely by the outer surface. Accordingly, it is beveled from the midpoint outwardly in both directions. As seen clearly in FIGS. 3 and 4, inner surface 28 is flat longitudinally. Thus, the assembled device such as illustrated in FIG. 1 has a tapered outer surface, designated generally be reference numeral 36, extending in both directions from midpoint 34.

Retaining ring 16, molded from a resilient elastomeric material such as E.P.D.M., has an axial configuration reflecting the outer central surface of the assembled shells. Each axial half tapers inwardly so that the ring is received conformably over the shells. The inner dimensions are preferably smaller than the outer dimensions; i.e., the circumferences at any given point, of the assembled shells. Accordingly, when the ring is mounted thereon, it is in a stretched condition.

A laterally projecting annular rim 38 is provided at each end of ring 16 to provide strength thereto.

Collars 18 are preferably a two piece construction: an outer insulating cover 40 and an inner member 42 of a relatively rigid material; e.g., aluminum. The cover is channel shaped with free ends 44*a* and 44*b* turning inwardly into notches 46 on the inner edges of the inner member. As shown in FIG. 3, free end 44*b* extends inwardly beyond the inner member. Cover 40 envelops and insulates the outer and side surfaces of the inner member while leaving inner surface 48 bare so as to provide metal-to-metal contact with shells 14.

Both cover 40 and inner member 42 are constructed so that the diameter of passage 50 through the collars decreases from end 52 to end 54. In other words, the wall 48 defining the passage converge. The amount of convergence is equated to the degree of taper formed by assembling shells 14 as shown in FIG. 1. The construction of collars 18 relative to the embodiment shown in FIGS. 5–7 differ in this respect as will be noted below.

With respect to the embodiment of FIGS. 1–4, inner surface 28 of shells 14 include a plurality of insulating piercing teeth 56 such as are shown in FIGS. 2–4. Further, spacing and alignment means, indicated generally by reference numeral 58 in FIG. 3, may be provided. Shown are inwardly projecting pointed ribs 60 and V-shaped grooves 62 cut into inwardly projecting flanges 64.

The spacing and alignment means used should be of a nature that includes guiding structures such as shown. Thus the assembly of the device is substantially simplified. Shells 14 are placed together with the spacing and alignment means spacing the shells apart, one from the other, in the proper, predetermined, spaced-apart distance and also in registration. Retaining ring 16 is slipped on over the shells to hold them in place as shown in FIG. 1. The retaining ring will exert an inward force on the shells, attempting to close or compress them into a smaller diameter. The frictional fit of ribs 60 and V-shaped grooves 62 is sufficient to resist this compressive force. The body formed by the assembled shells define passage 66 extending therethrough. Collars 18 are pushed onto each end of the body by hand just far enough to hold them in place. FIG. 5 shows device 10 in this stage. The drawing also shows cables 20 inserted into passage 66 from each end.

FIG. 4 is a cross-sectional view after collars 18 have been forcefully driven up the tapered surface of the body. Arrows 68 indicate the direction of travel. As the collars move in, the tapered walls 48 of the collars force the shells inwardly towards each other so as to reduce the diameter of passage 66. Teeth 56 bite through cable insulation 24 and into strands 22 to make electrical connection therewith. The force required to drive the collars is great enough to overcome the frictional forces between ribs 60 and grooves 62.

The length of collars 18 are predetermined so that, as they move up on the tapered surfaces, the ends 32 thereof catch free ends **44*b* and cause them to mushroom. The direction of mushrooming is towards cables 20 so that a seal is provided around passage 66**. The terminated portion of the cables within the passage becomes enviromentally sealed.

Retaining ring 16, being in a stretched condition originally, follows the compressed shells to maintain a tight band thereabout.

Embodiment 12 differs from embodiment 10 in that insulation piercing teeth 70 are movably mounted in openings 72 in shells 14. These teeth are of differing lengths to accommodate the changing thickness of shells 14. Collars 18 are modified to provide axial grooves 74 in wall 48. The grooves decrease in depth towards the outer end of the collars. The collars are mounted on the body formed by the assembled shells with the teeth extending into the grooves as shown in FIG. 5. As the collars are driven up the tapered surfaces of the body, the teeth are driven into cables 20, piercing the insulating jacket and making electrical contact with the underlying conductors 22.

FIG. 6 is an end sectional view showing the positioning of teeth 70 in grooves 74. FIG. 7 is also an end view showing the teeth driven into cable 20.

One other difference exists in embodiment 12; i.e., just one set of alignment means 58 are employed.

We claim:

1. An insulation piercing, coaxial grip splice device comprising:

a. an elongated body having a tapered outer surface converging from a common midpoint toward each end, a passage therethrough with insulation piercing teeth positioned on the walls defining the passage and extending inwardly, said teeth being adapted to be driven into insulation covered cable which may be positioned in the passage, said body being formed from a pair of elongated shells having concave surfaces cooperating to form the passage when mated with one concave surface having a rib positioned normal to the longitudinal axis and midway between the ends and the other concave surface having a groove positioned to receive the rib to frictionally hold the assembled shells together in a predetermined, spaced-apart relation; and b. collars having a tapered passage therethrough slidably mounted on each end of the assembled, spaced-apart shells and adapted to compress the shells towards each other by being driven up the tapered outer surface.

2. An insulation piercing, coaxial grip splice device comprising:

a. an elongated body having an outer surface converging from the center towards each end, a passage therethrough of constant diameter, a plurality of openings in the body which intersect the passage and insulation piercing teeth slidably positioned in the openings with one end extending outwardly from the outer surface; and b. collars having a tapered passage therethrough with an axially extending groove in the wall defining the passage, said collars being slidably mounted on each end of the body with the grooves in alignment with the teeth so that as the collars are driven up the outer surfaces, the teeth are driven into an insulation covered cable which may be positioned in the passage.

3. The splice device of claim 2 wherein the grooves have beveled floors and the teeth are of differing lengths to accommodate the changing thickness of the body.

4. The splice device of claim 3 wherein the openings are in an axial alignment with each other.

5. The splice device of claim 4 wherein there are two or more axially aligned rows of grooves between the center of the body and each end.

* * * * *